US006021525A

United States Patent [19]

Mertins

[11] Patent Number: 6,021,525

[45] **Date of Patent: *Feb. 8, 2000**

[54] DUAL USE HAVELOCK

[76] Inventor: Joerg Thomas Mertins, 7712 Ridgecrest Dr., Alexandria, Va. 22308

[ * ] Notice: Under 35 U.S.C. 154(b), the term of this patent shall be extended for 70 days.

[21] Appl. No.: 08/639,737

[22] Filed: Apr. 29, 1996

[51] Int. Cl.[7] ..... A42B 1/06

[52] U.S. Cl. ..... 2/172; 2/181.4; 2/209.13; 40/329

[58] Field of Search ..... 2/172, 181, 181.2, 2/181.4, 209.13; 40/329

[56] References Cited

U.S. PATENT DOCUMENTS

| | | | |
|---|---|---|---|
| 5,046,195 | 9/1991 | Koritan | 2/172 |
| 5,161,259 | 11/1992 | Shorts | 2/209.13 |
| 5,493,734 | 2/1996 | Nieves-Rivera | 2/172 |

*Primary Examiner*—Diana Oleksa

*Attorney, Agent, or Firm*—Jim Zegeer

[57] ABSTRACT

There is disclosed a havelock or neck shield attachment for a baseball type cap having a hemispheric opening and adjustment strap at the rear thereof and bill in the front, the attachment includes a securement loop portion for securing the attachment to the adjustment strap of the cap. A connector portion has first and second ends and diverging side edges between the first and second ends, the first end being secured to said securement loop forming portion and a deployable neck shield portion connected to the second end of the connector portion. The connector portion is shaped such that when stowed inside the cap, the connector portion fills the hemispheric opening and when deployed the connector portion positions the deployable neck shield in position to protect the user's neck from sun rays. The inside surface of the connector portion can carry decorative surface ornamentation (which can be a team logo) and when in a stowed position, the decorative surface ornamentation is presented for viewing.

7 Claims, 5 Drawing Sheets

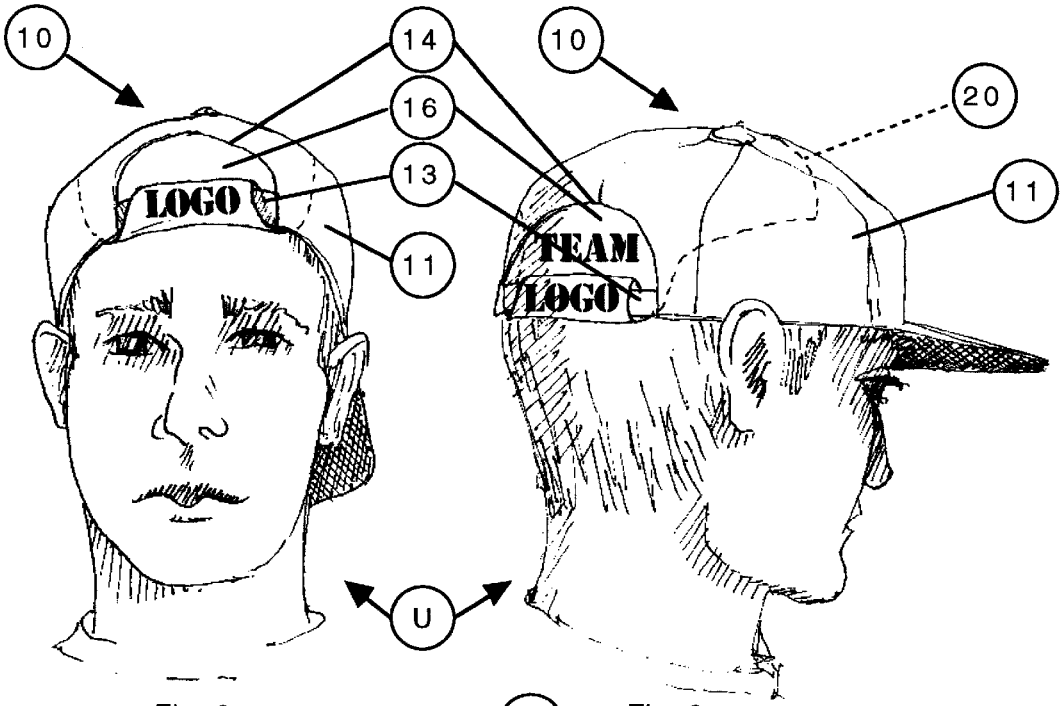
Fig. 8
Fig. 9
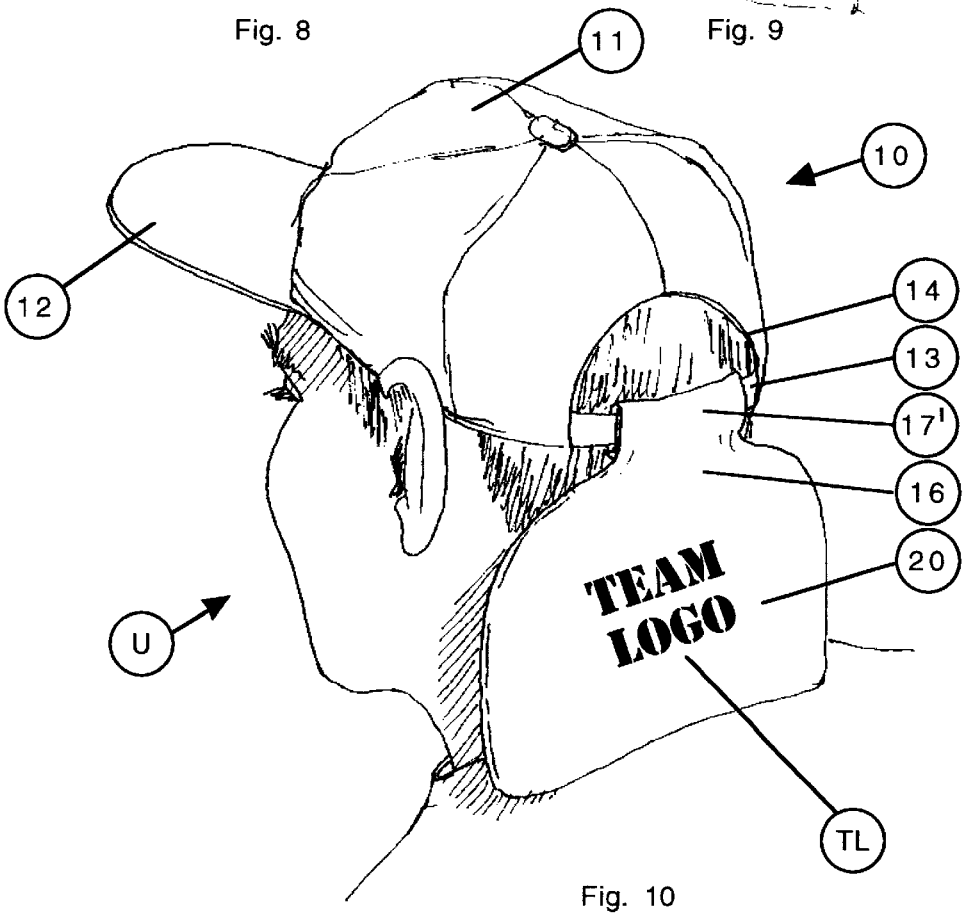
Fig. 10

DUAL USE HAVELOCK

BACKGROUND OF THE INVENTION

1. Field of the Invention

The invention relates to head coverings for sun protection. More specifically, the invention relates to a dual use havelock type garment which is adapted to be attached to a "Baseball-type-cap" in a manner that when worn as a havelock it protects the neck and when worn another way it protects the forehead.

2. Description of the Prior Art

Koritan U.S. Pat. No. 5,046,195 relates to a headband and a rectangular neck shield or flap or havelock in which an elastic headband supports a neck shield or havelock.

Shorts U.S. Pat. No. 5,161,259 discloses a neck covering protective garment or havelock which includes a rear cape like piece for attaching to the adjustment strap of a standard baseball cap.

Christiansen et al. U.S. Pat. No. 5,287,559 discloses a cap strap cover comforter for attachment to the adjustment or sizing strap of a baseball style cap. It includes a semicircular element which fills the hemispherical opening above the sizing or adjustment strap to which a logo can be imprinted. It is retained in place by hook and loop fasteners.

Pizzacar U.S. Pat. No. 5,003,640 discloses an advertising cap name plate which is secured or attached to the adjustment strap of a standard baseball type cap.

The object of the present invention is to provide an improved dual use havelock for use with baseball type caps. A further objective of the invention is to provide a dual use havelock in which, when deployed, the havelock protects the neck of the user and when stowed a portion fills the hemispheric open space above the adjustment or sizing strap of a baseball style cap. A further objective of the invention is to provide a dual use neck covering or havelock type garment which presents insignia or logos when used as a neck protector or havelock or when used as a protection filling the open hemispherical shaped portion of a baseball type cap which is above the adjustment or sizing strap.

The invention is particularly applicable to baseball type caps having a hemispheric opening and adjustment or sizing strap at the rear thereof and bill in the front.

According to the invention, the attachment has a securement portion integrally coupled to a connector portion having first and second ends and diverging side edges between the first and second ends, and an integral deployable neck shield portion which is connected to the second end.

The connector portion is shaped such that when folded and stowed inside the cap, the connector portion fills the hemispheric opening to protect the user's forehead from sun rays when worn in reverse style and when deployed the connector portion positions the deployable neck shield in the most advantageous position to protect the user's neck from sun rays.

In a preferred embodiment, a loop or passage is formed at the first end of the connector portion through which passes the adjustment strap of the cap. The loop or passage can be formed using stitching or hook and loop fasteners.

Logos can be provided on the front and back of the garment. The back side of the connector portion can be impressed with a logo such that when the neck shield or havelock portion is stowed inside the cap the logo is positioned for viewing through the hemispheric opening above the adjustment strap or sizing strap.

Thus the invention is a one piece garment which is designed primarily for sun protection and is attached to the adjustment strap of a baseball cap where there is a hemispherical opening. The invention has a dual function, it can be worn two entirely different ways to cover two different areas, protecting the forehead when worn one way and protecting the neck when worn the other way.

An additional object of this invention is to provide shielding from the sun. When the neck shield is deployed the apparatus protects the neck. When the apparatus is retracted and flipped up inside the baseball cap, when worn in a reverse style, the forehead is protected.

A further objective of the invention is for advertising purposes. Various logos can be displayed in either of the two ways in which the device is worn.

DESCRIPTION OF THE DRAWINGS

Other objects, advantages and features of the invention will become more evident in the following descriptions when considered with the attached drawings wherein:

FIGS. 8, 9, & 10 show various surface ornamentation and design or advertisement options.

DETAILED DESCRIPTION OF THE INVENTION

Figure 1:
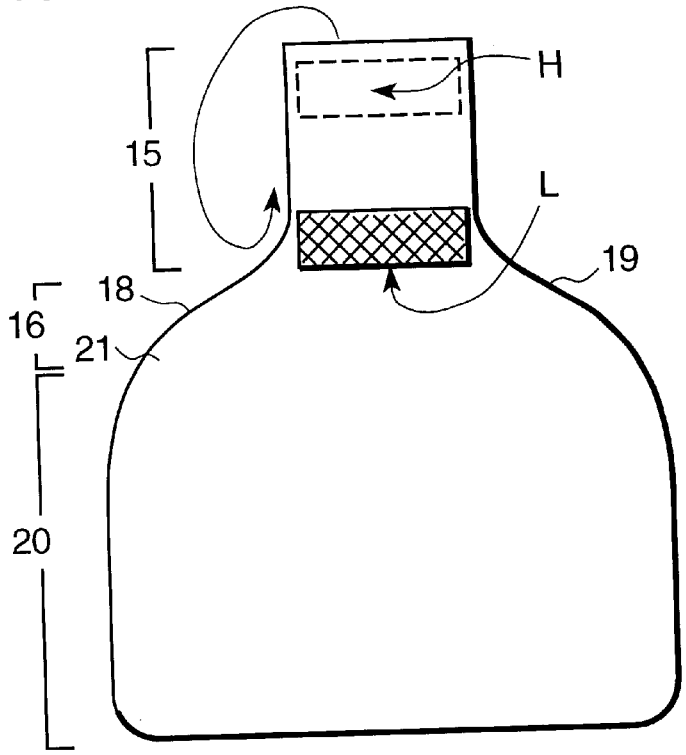
FIG. 1 shows a havelock or neck incorporating the invention.

As shown in FIGS. 5–10 a conventional baseball type cap 10 has a hemispherical shaped head covering shell portion 11, visor 12, adjusting or sizing strap 13 and a hemispherical opening 14 on the back of the cap above the adjustment straps 13. The adjustment strap 13 can include hook and loop, buckle and hole and knob type fasteners, or be an elastic strap.

Figure 5:
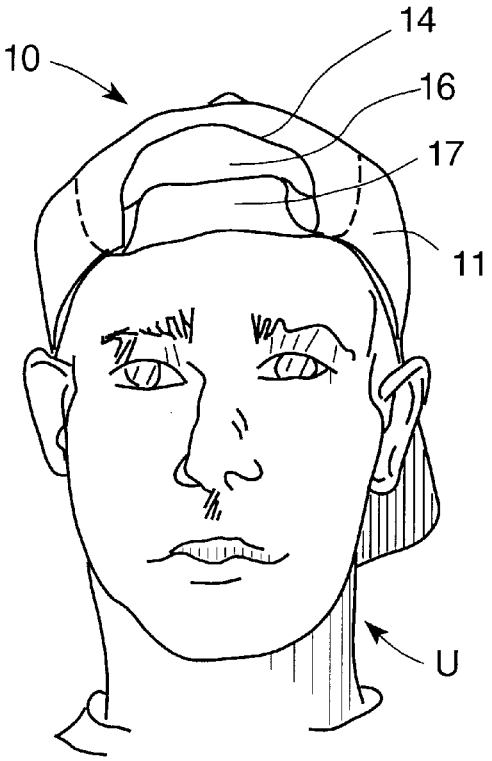
FIG. 5 shows the retracted shield when cap is worn in reverse.

The hemispherical opening 14 exposes the head of the wearer to sun rays, particularly when worn in the reverse fashion in the manner shown in FIGS. 5 and 8. The invention provides protection to the exposed portion of the user's head in a comfortable and somewhat unobtrusive fashion while at the same time providing an effective stowage position for the neck shield or havelock 20.

(FIGS. 1–4)

Referring to FIGS. 1–4, the garment includes a rectangular securement attachment portion 15, a connector portion 16 having a first end 17 joined to the rectangular securement portion 15 with smoothly diverging side edges 18 and 19 leading to a generally rectangularly shaped deployable neck shield or havelock portion 20 which is connected to a second end 21 of the connector portion.

Connector portion 16 is shaped such that when folded inside the hemispheric head covering portion 11 of the cap 10 it is able to fill the hemispheric opening 14 without gathering excess material around the sides of the cap and changing the fit or making the presence of the connector portion 16 and havelock portion 20 noticeable to the wearer, the gradual merging of the connector edges 18 and 19 from the securement portion 15 to the neck shield or havelock portion 20 also spans and fills the hemispheric opening 14.

Figure 2:
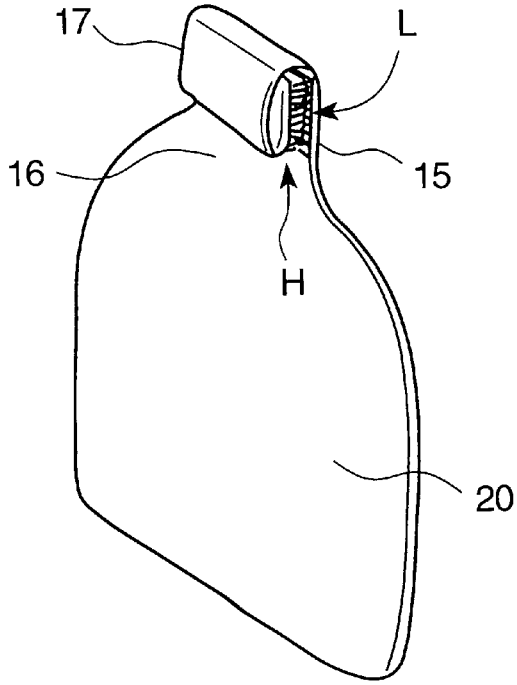
FIG. 2 shows the shield with the loop closed using velcro.
Figure 3:
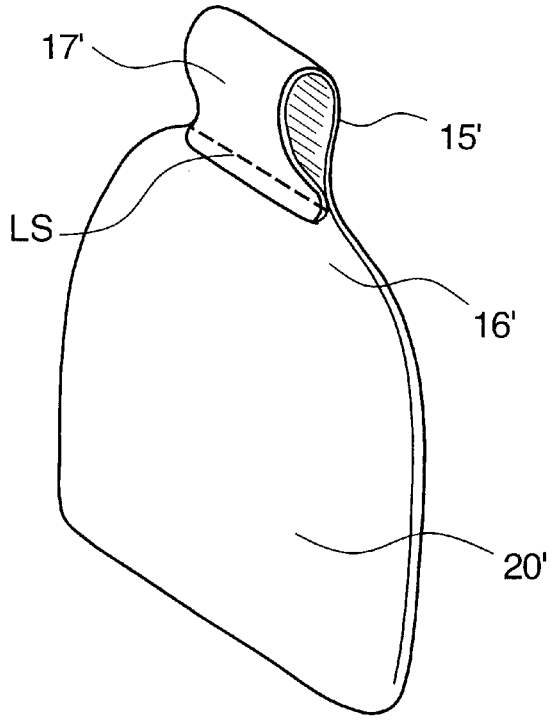
FIG. 3 shows the alternate closure of a stitched loop.
Figure 4:
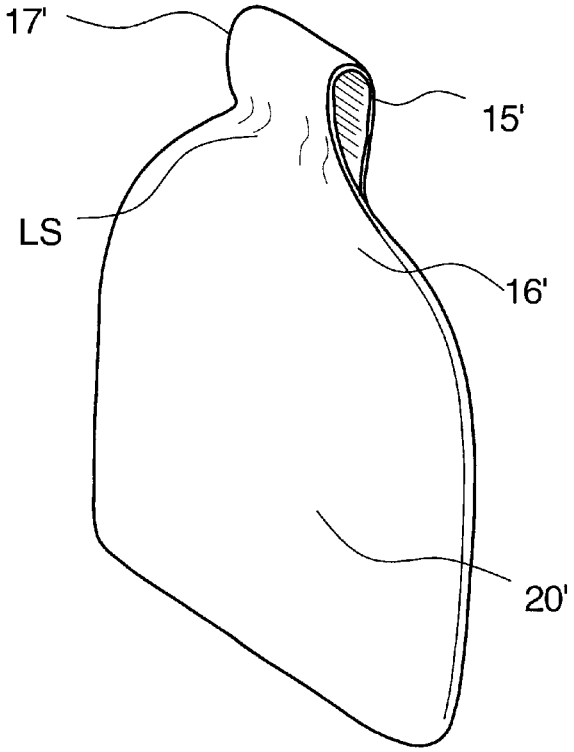
FIG. 4 shows another alternate closure an integrated loop.

The securement portion 15 is preferably adapted to form a loop 17 (FIG. 2). In the embodiment of FIGS. 1 and 2 hook H and loop L fastener loop 17 is formed through which passes the adjustment or sizing strap 13. In FIGS. 3 and 4, loop 17' is formed by a line of stitching LS and the adjustment or sizing straps 13 are threaded through loop 17' and then secured to each other or a buckle (not shown) on the cap or hole and knot type fasteners are secured in any desired size adjustment. The hemispheric opening 14 allows this size adjustment.

Figure 6:
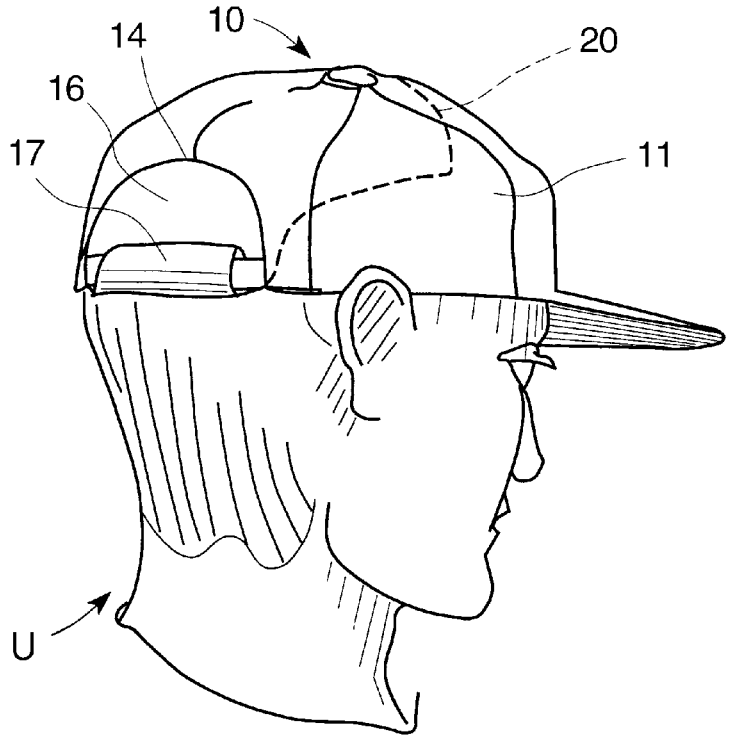
FIG. 6 shows the retracted shield when cap is worn in normal fashion.
Figure 7:
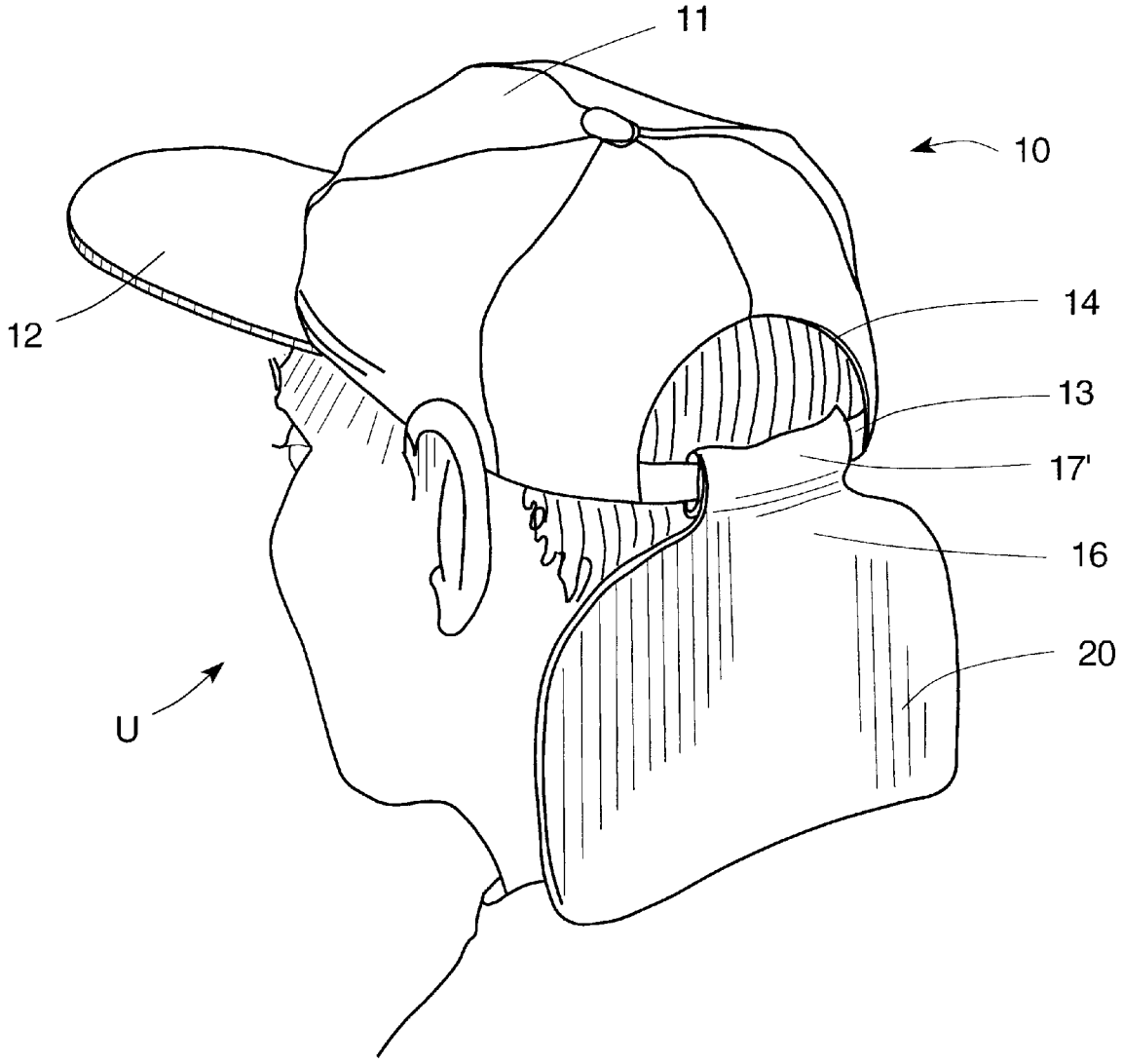
FIG. 7 shows the neck shield when it is deployed, and the cap is worn in normal fashion, protecting the neck.

FIGS. 5–10 illustrate the invention in use. FIGS. 5 and 6 illustrate the popular reverse manner of wearing a baseball style cap. Without the present invention, the hemispheric opening 14 would expose the forehead of the user U. When the neck shield 20 is in the stowed position the connector portion 16 is adapted to span the hemispheric opening 14 without significant gathering or pleating of material at the edges or sides. When the neck shield 20 is in the deployed position as shown in FIG. 7 (as well as in FIG. 10), the neck of the user is protected from the sun's rays as well as from the weather elements. As shown in FIG. 6 (as well as in FIG. 9) the cap can be worn with the neck shield 20 in a stowed and comfortable position in the cap position 11, by folding about the adjustment strap 13.

Although the fabric may be plain or use team colors or colors complementary to the color of the cap 11 or visor 12, team insignia or logos can be impressed or attached as shown in FIGS. 8–10. An advantageous feature of the connector portion 16 is that a team logo can be attached to the "inside" surface ("inside" when connecting the neck shield or havelock 20 to the attachment portion 15 or loop 17') which will become the "outside" surface for viewing in the hemispheric aperture. The edges of the cap defining the hemispheric opening can be provided with contrasting color if desired. As shown in FIG. 10, a team logo TL or other insignia or design is emblazoned on the outside surface of the neck shield 20. Note that in FIG. 9, a portion of the logo is on the attachment loop 17 and a portion is on the connector portion 16 which appears in the hemispheric opening.

Summarizing, the device is specifically designed to be attached to the rear closure of a standard style baseball cap. It can be utilized for outdoor activities where sun exposure is to be expected. Besides protecting the neck or the forehead, depending on which way the shield is worn, the added material acts as padding on the strap as well as being able to absorb any perspiration that may occur. There is also the possibility of adding embroidered team logos or manufacturer logos to the device for surface ornamentation or advertising purposes.

The shield can be manufactured out of any sun blocking material, however cotton should be utilized, and is preferred, in order to keep the wearer cooler and more comfortable.

As shown above the attaching position 15 of the shield can vary. As described in FIGS. 1 through 4 the loop by which the device is attached to the adjustment strap can use a hook and loop closure, in which case the loop can be opened, or a closed loop can be employed in which case the manufacturing costs would be kept to a minimum.

While preferred embodiments of the invention have been shown and described it will be appreciated that various modifications, adaptations and changes can be made without departing from the spirit and scope of the invention.

What is claimed is:

1. An attachment for a baseball type cap having a hemispheric opening and adjustment strap at the rear thereof and bill in the front, comprising, securement means for securing said attachment only to the adjustment strap of said cap, a connector portion having first and second ends and downwardly diverging side edges between said first and second ends, said first end being secured to said securement means, a deployable neck shield portion connected to said second end, said connector portion being shaped such that when folded inside said cap, said connector portion fills said hemispheric opening to protect a user's forehead when worn in reverse style and when deployed said connector portion positions said deployable neck shield in position to protect a user's neck from sun rays.

2. The attachment defined in claim 1 wherein said securement means includes hook and loop fasteners.

3. The attachment defined in claim 1 wherein said attachment has an inside surface and an outside surface, said connector portion has impressed on its inside surface indicia which is positioned in said hemispheric opening when worn in said reverse style, and said deployable neck shield has indicia impressed on its outside surface for viewing when said neck shield is deployed.

4. A fabric attachment for a baseball type cap having a front and rear and hemispheric opening and adjustment strap at the rear thereof and bill in the front, said attachment comprising, securement portion for securing said attachment solely to the adjustment strap of said cap, a connector portion having first and second ends and downwardly diverging side edges between said first and second ends, said first end being secured to said securement portion, a deployable neck shield portion connected to said second end, said connector portion being shaped such that when folded inside said cap, said connector portion fills said hemispheric opening to protect a user's forehead when worn in reverse style and when deployed, said connector portion positions said deployable neck shield in position to protect a user's neck from sun rays.

5. An improved baseball type cap having a hemispheric opening and adjustment strap at the rear thereof and bill in the front, wherein the improvement comprises a neck shield attachment comprising;

a loop forming portion for securing to the adjustment strap of said cap, a connector portion having first and second ends and diverging side edges between said first and second ends, said first end being secured to said loop forming portion, a deployable neck shield portion connected to said second end, said connector portion being shaped such that when stowed inside said cap, said connector portion fills said hemispheric opening and when deployed said connector portion positions said deployable neck shield in position to protect a user's neck from sun rays and wherein said connector portion has an inside surface when said neck shield is deployed which becomes positioned in and fills said hemispheric opening when stowed and includes decorative surface ornamentation on said inside surface.

6. The baseball type cap as defined in claim 5 including second decorative surface ornamentation on said loop forming portion which combines with the first decorative surface ornamentation to present a unified surface ornamentation to a viewer.

7. The baseball type cap defined in claim 6 including third decorative surface ornamentation on said neck shield portion of said neck shield attachment.

* * * * *